US010188996B2

(12) United States Patent
Stein et al.

(10) Patent No.: US 10,188,996 B2
(45) Date of Patent: Jan. 29, 2019

(54) POWDER MIXING APPARATUS AND METHOD OF USE

(71) Applicant: Adamis Pharmaceuticals Corporation, San Diego, CA (US)

(72) Inventors: Stephen W. Stein, St. Paul, MN (US); Michael W. Mueting, St. Paul, MN (US); Herbert C. Chiou, St. Paul, MN (US); James S. Stefely, St. Paul, MN (US)

(73) Assignee: Adamis Pharmaceuticals Corporation, San Diego, CA (US)

( * ) Notice: Subject to any disclaimer, the term of this patent is extended or adjusted under 35 U.S.C. 154(b) by 500 days.

(21) Appl. No.: 14/874,232

(22) Filed: Oct. 2, 2015

(65) Prior Publication Data

US 2017/0095782 A1 Apr. 6, 2017

(51) Int. Cl.

| | |
|---|---|
| ***B01F 13/02*** | (2006.01) |
| ***B01F 3/18*** | (2006.01) |
| ***B01F 5/10*** | (2006.01) |

(52) U.S. Cl.

CPC ..... *B01F 13/02* (2013.01); *B01F 3/18* (2013.01); *B01F 5/10* (2013.01); *B01F 5/102* (2013.01); *B01F 13/0205* (2013.01); *B01F 13/0227* (2013.01); *B01F 2215/0032* (2013.01)

(58) Field of Classification Search

USPC ..... 366/107, 348

See application file for complete search history.

(56) References Cited

U.S. PATENT DOCUMENTS

| | | | | |
|---|---|---|---|---|
| 3,003,751 | A * | 10/1961 | Trost | B01F 5/0256 118/303 |
| 3,904,087 | A | 9/1975 | McRoskey et al. | |
| 4,326,810 | A * | 4/1982 | Schofield | C04B 7/38 366/106 |
| 4,596,497 | A | 6/1986 | Yamada et al. | |
| 6,074,135 | A * | 6/2000 | Tapphorn | B05B 5/047 406/46 |
| 7,267,475 | B2 * | 9/2007 | Steele | B01F 3/18 366/101 |
| 7,530,729 | B2 * | 5/2009 | O'Callaghan | B01F 3/18 141/83 |
| 8,223,984 | B2 * | 7/2012 | Roos | A61F 11/14 381/353 |

(Continued)

FOREIGN PATENT DOCUMENTS

| | | | |
|---|---|---|---|
| DE | 1256630 | * | 12/1967 |
| DE | 1256630 B | | 12/1967 |

(Continued)

OTHER PUBLICATIONS

DE 1256630, Dec. 1967, Joob, machine translation.*

(Continued)

*Primary Examiner* — Mark Halpern

(74) *Attorney, Agent, or Firm* — K&L Gates LLP; Louis C. Cullman; Hal Gibson

(57) ABSTRACT

Disclosed herein are powder mixing apparatuses and methods that utilize the deagglomerizing and mixing effects of an air flow that impacts a flowing powder. The resulting powder can have smaller particle sizes and/or exhibit a more homogenous mixture than the premixed powder.

19 Claims, 4 Drawing Sheets

(56) References Cited

U.S. PATENT DOCUMENTS

| | | | | |
|---|---|---|---|---|
| 2002/0058136 | A1* | 5/2002 | Belhadjhamida | B22F 3/1025 428/312.2 |
| 2003/0205096 | A1* | 11/2003 | Gehner | B01F 3/02 73/863 |
| 2009/0073799 | A1* | 3/2009 | Bourlart | B01F 3/02 366/107 |
| 2011/0240753 | A1* | 10/2011 | Stevenson | B05B 7/30 239/8 |
| 2014/0361052 | A1* | 12/2014 | Suijver | A47J 31/404 222/630 |

FOREIGN PATENT DOCUMENTS

| | | | |
|---|---|---|---|
| JP | 10114428 | A | 5/1998 |
| WO | 1995/023645 | A1 | 9/1995 |
| WO | 2017/059128 | A1 | 4/2017 |

OTHER PUBLICATIONS

International Search Report and Written Opinion dated Jan. 20, 2017 for International Application No. PCT/US2016/054528 filed on Sep. 29, 2016.

* cited by examiner

POWDER MIXING APPARATUS AND METHOD OF USE

FIELD

The present disclosure relates generally to powder mixing apparatuses and methods.

BACKGROUND

Mixing particulates or powders can be more difficult than mixing liquids. This can be apparent when one desires to precisely and accurately mix a known volume or mass of material. While a number of industrial processes and devices are directed towards powder mixing, these processes and devices have several disadvantages.

For example, a common method of mixing two or more powders involves combining the powders in an enclosed volume, such as a bag, and shaking or vigorously agitating the enclosed volume to mix the powders together. However, such a process achieves very limited results, and the resulting mixed powder remains relatively heterogeneous. Such methods are unsuitable for some situations, such as where small doses of a drug are to be delivered such that more reliable methods of mixing is required if there is to be any certainty in the amount of drug that is delivered.

SUMMARY

Features and advantages of this disclosure will be understood upon consideration of the detailed description and claims. These and other features and advantages are described below in connection with various embodiments of the present disclosure. The summary is not intended to describe all embodiments or every implementation of the subject matter presently disclosed.

The subject matter of this disclosure, in its various combinations, either in apparatus or method form, may include the following list of embodiments:

According to some embodiments of the present disclosure, a powder mixing apparatus includes a powder input portion comprising a dispensing device and a mixing portion. In some embodiments, the mixing portion includes a powder inlet, a gas inlet, and a mixing cavity. In some embodiments, the dispensing device comprises an opening configured to dispense a premixed or pre-blend powder into the mixing portion. In some embodiments, the opening includes a tube, which can be a venturi tube. In some embodiments, the gas inlet is configured to provide a flow of gas into the mixing cavity. In some embodiments, the gas and the premixed powder interact in the mixing cavity to form a post-mixed or blended powder.

According to some embodiments of the present disclosure, a method of mixing a powder includes providing a premixed or pre-blend powder to a powder input portion—the powder input portion comprising a dispensing device—and mixing the premixed powder in a mixing portion. In some embodiments, the mixing portion includes a powder inlet, a gas inlet, and a mixing cavity. In some embodiments, the dispensing device includes an opening configured to dispense the premixed powder into the mixing portion. In some embodiments, the gas inlet is configured to provide a flow of gas into the mixing cavity, and the powder inlet is configured to dispense the premixed powder into the mixing cavity. In some embodiments, the flow of gas and the premixed powder interact in the mixing cavity to form a post-mixed or blended powder.

These and other aspects of the present disclosure will become readily apparent to those of ordinary skill in the art from the following detailed description together with the drawings.

BRIEF DESCRIPTION OF THE DRAWINGS

The disclosure may be more completely understood, and those having ordinary skill in the art to which the present disclosure pertains will more readily understand how to make and use the disclosed subject matter, in consideration of the following detailed description of various exemplary embodiments of the disclosure in connection with the accompanying drawings, in which.

The figures are not necessarily to scale and like numbers used in the figures can refer to like components. However, it will be understood that the use of a number to refer to a component in a given figure is not intended to limit the component in another figure labeled with the same number.

DETAILED DESCRIPTION

Figure 1:
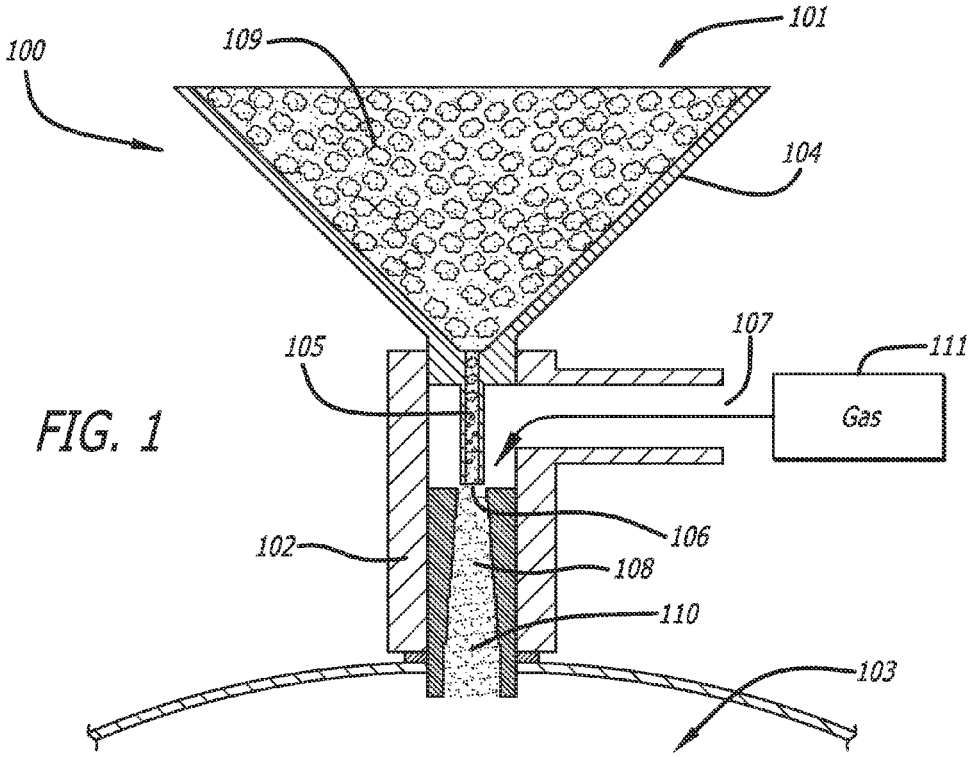
FIG. 1 is a schematic cross-sectional side view of the powder mixing apparatus as viewed along line A in FIG. 2.

In the following description, reference is made to the accompanying drawings that forms a part hereof, and in which are shown by way of illustration several exemplary embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

As used in this disclosure, the term "premixed" refers to a powder that is to be subjected to a mixing process disclosed herein or processed through a mixing apparatus disclosed herein. However, the term can include a powder that has previously been subjected to at least some mixing. For example, in some embodiments, it is contemplated that a powder, which may comprise a mixture of two or more component powders, is mixed together by hand or by mechanical mixing prior to being mixed and deagglomerated as disclosed herein.

As used herein, the term "post-mixed," then, refers to a powder that has been subjected to a mixing process disclosed herein or processed through a mixing apparatus disclosed herein even if that powder will again be subjected to the same or similar process, i.e., it will be processed multiple times. In such circumstances, the powder may be referred to as a post-mixed powder with respect to the first mixing step that has already occurred but as a premixed powder with respect to any future mixing steps.

According to some embodiments of a powder mixing apparatus, the apparatus includes a first powder input portion and a first mixing portion. In some embodiments, the first powder input portion comprising a first dispensing device. In some embodiments, the first mixing portion includes a first powder inlet, a first gas inlet, and a first mixing cavity. In some embodiments, the first dispensing device comprises a first opening configured to dispense a first premixed powder into the first mixing portion. In some embodiments, the opening includes a tube or elongate structure, which in some embodiments is a venturi tube. In some embodiments, the first gas inlet is configured to provide a first flow of gas into the first mixing cavity. In some embodiments, the gas and the first premixed powder interact in the first mixing cavity to form a first post-mixed powder.

In some embodiments, the powder mixing apparatus further includes a second powder input portion and a second mixing portion. In some embodiments, the second powder input portion includes a second dispensing device. In some embodiments, the second mixing portion includes a second powder inlet, a second gas inlet, and a second mixing cavity. In some embodiments, the second input portion receives the first post-mixed powder from the first powder mixing portion. In some embodiments, the second dispensing device comprises a second opening configured to dispense the first post-mixed powder into the second mixing portion. In some embodiments, the second opening includes a tube or elongate structure, which in some embodiments is a venturi tube. In some embodiments, the second gas inlet is configured to provide a second flow of gas into the second mixing cavity, and the second powder inlet is configured to dispense the first post-mixed powder into the second mixing cavity. In some embodiments, the second flow of gas and the first post-mixed powder interact in the second mixing cavity to form a second post-mixed powder. In some embodiments, the second mixing portion is positioned to deliver the second post-mixed powder to the first powder input portion.

In some embodiments, the powder mixing apparatus further includes a second powder input portion and a second mixing portion. In some embodiments, the second powder input portion comprises a second dispensing device. In some embodiments, the second mixing portion includes a second powder inlet, a second gas inlet, and a second mixing cavity. In some embodiments, the second gas inlet is configured to provide a second flow of gas into the second mixing cavity. In some embodiments, the second flow of gas and a second premixed powder received from the second powder input portion interact in the second mixing cavity to form a second post-mixed powder. In some embodiments, the first mixing portion and the second mixing portion are positioned so that the first post-mixed powder, and second post-mixed powder are dispensed together into a third powder input portion to form a third premixed powder.

According to some embodiments, a powder mixing apparatus also includes a third mixing portion comprising a third powder inlet, a third gas inlet, and a third mixing cavity. In some embodiments, the third gas inlet is configured to provide a third flow of gas into the third mixing cavity. In some embodiments, the third flow of gas and the third premixed powder received from the third powder input portion interact in the third mixing cavity to form a third post-mixed powder.

In some embodiments, the first premixed powder comprises at least two powders. In some embodiments, the first opening includes a tube or elongate structure that extends or protrudes into the mixing portion. In some embodiments, at least one of the first, second, and third gas inlets delivers a compressed gas. In some embodiments, the flow of gas through the at least one of the first, second, and third mixing portions is configured to create suction through the respective openings thereby drawing the premixed powder into the respective mixing cavity. In some embodiments, at least one of the first, second, or third flows of gas passing a powder inlet effects a high shear on a premixed powder as it enters a mixing portion.

In some embodiments, the first, second, and/or third mixing portion further comprises a control system. In some embodiments, the control system is configured to regulate the volume of powder and gas dispersed into the appropriate mixing portion.

In some embodiments, the premixed powder is cohesive. In some embodiments, the cohesive premixed powder has a repose angle greater than about 40 degrees. In some embodiments, the cohesive premixed powder has a Jenike flow index of less than about 4. In some embodiments, the cohesive premixed powder has a Carr index of greater than about 20. In some embodiments, the cohesive premixed powder has an average, primary particle size of less than about 20 microns. In some embodiments, the cohesive premixed powder comprises a drug. In some embodiments, the cohesive premixed powder comprises more than 2% by weight of free water. In some embodiments, the cohesive premixed powder comprises fine agglomerates with an average dimension of 20 to 2000 microns.

According to some embodiments disclosed herein, a method of mixing a powder includes providing a first premixed powder to a first powder input portion and, subsequently, to a first mixing portion where the premixed powder is subjected to a gas flow. In some methods, the first powder input portion includes a first dispensing device. In some methods, the method includes mixing the first premixed powder in a first mixing portion that includes a first powder inlet, a first gas inlet, and a first mixing cavity. In some methods, the first dispensing device comprises a first opening configured to dispense the first premixed powder into the first mixing portion. In some methods, the first gas inlet is configured to provide a first flow of gas into the first mixing cavity, and the first powder inlet is configured to dispense the first premixed powder into the first mixing cavity. In some methods, the first flow of gas and the first premixed powder interact in the first mixing cavity to form a first post-mixed powder.

Some methods of mixing a powder further include providing the first post-mixed powder to a second powder input portion, the second powder input portion having a second dispensing device, and mixing the first post-mixed powder in a second mixing portion. In some methods, the second mixing portion includes a second powder inlet, a second gas inlet, and a second mixing cavity. In some methods, the second dispensing device has a second opening configured to dispense the first post-mixed powder into the second mixing portion. In some methods, the second gas inlet is configured to provide a second flow of gas into the second mixing cavity, and the second powder inlet is configured to dispense the first post-mixed powder into the second mixing cavity. In some methods, the second flow of gas and the first post-mixed powder interact in the second mixing cavity to form a second post-mixed powder. In some methods, a method of mixing a powder also includes transporting the second post-mixed powder to the first powder input portion.

Some methods include the step of providing a second premixed powder to a second powder input portion, the second powder input portion comprising a second dispensing device, and mixing the second premixed powder in a second mixing portion. In some methods, the second mixing portion includes a second powder inlet, a second gas inlet, and a second mixing cavity. In some methods, the second dispensing device comprises a second opening configured to dispense the second premixed powder into the second mixing portion. In some methods, the second gas inlet is configured to provide a second flow of gas into the second mixing cavity, and the second powder inlet is configured to dispense the second premixed powder into the second mixing cavity. In some methods, the second flow of gas and the second premixed powder interact in the second mixing cavity to form a second post-mixed powder. In some methods, the first mixing portion and the second mixing portion are positioned so that the first post-mixed powder and second post-mixed powder are dispensed together into a third powder input portion to form a third premixed powder.

Some methods of the present disclosure further include the step of mixing the third premixed powder in a third mixing portion comprising a third powder inlet, a third gas inlet, and a third mixing cavity. In some methods, the third gas inlet is configured to provide a third flow of gas into the third mixing cavity. In some methods, the third flow of gas and the third premixed powder received from the third powder input portion interact in the third mixing cavity to form a third post-mixed powder.

According to some embodiments of the present disclosure, a method of mixing a powder achieves a more homogeneous mixture. For example, samples taken of the powder before mixing will indicate the relative amounts of the components of the powder. However, the difference in the results between different samples will vary depending on how well the powder is mixed. In some embodiments disclosed herein, subjecting the powder to the presently disclosed mixing methods and/or using the disclosed apparatuses will reduce the variation between samples. As explained in greater detail below, the variation between samples can be characterized as % RSD (the relative standard deviation between different samples). Disclosed herein are methods that involve the use of a jet of air or gas to deagglomeration and/or mix a premixed powder where subjecting the premixed powder to such a process can reduce the % RSD of the premixed powder to a desirable level.

For example, in some embodiments, the % RSD of a post-mixed powder is less than about 70% of the % RSD of the powder before it was subjected to the jet of air or gas. In some embodiments, the % RSD of the post-mixed powder is less than about 60%, less than about 50%, less than about 40%, less than about 30%, less than about 20%, or even less than about 10% of the % RSD of the premixed powder. In some embodiments, the % RSD of the post-mixed powder is between about 0-60%, between about 0-30%, between about 0-10%, between about 1-8%, between about 5-20%, between about 5-30%, or between about 10-20% of the % RSD of the premixed powder. In some embodiments, the powder is subjected to the jet of gas at least two times, which further reduces the % RSD. However, repeatedly subjecting the powder to additional jets of gas may have limited effects.

Figure 2:
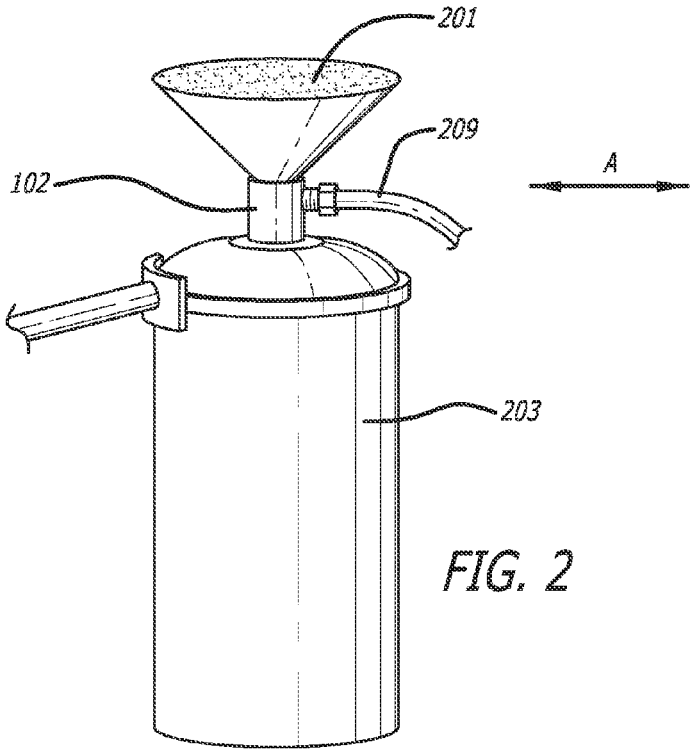
FIG. 2 is a schematic top perspective view of a powder mixing apparatus.

One embodiment of a powder mixing apparatus 100 is shown in FIGS. 1-2. The powder mixing apparatus 100 has a powder input portion 101, a mixing portion 102, and a collection portion 103. A powder input portion comprises a dispensing device 104. Dispensing device 104 can comprise a hopper, funnel, tube, container, or the like. For example, a dispensing device can deliver powder by a hopper where the powder is fed into a system or a tube where the powder is pulled or pushed through the tube. In the illustrated embodiment, dispensing device 104 includes a venturi tube 105, which can be integrated into the bottom or one end of the dispensing device 104. Some embodiments do not utilize a venturi tube but rather allow the powder to flow through an opening. In some embodiments, a tube other than a venturi tube is used, and in some embodiments, an elongate structure is used. The term "elongate structure" includes its generally accepted meaning within the art as well as a structure with an inner passageway in which the inner diameter of the passageway is less than the length of the passageway. Venturi tube 105 can collect the material from the dispensing device 104 and dispense material into another device, such as a mixing portion 102.

Mixing portion 102 can comprise a powder inlet 106, a gas inlet 107, and a mixing cavity 108. In some embodiments, the powder inlet 106 of the mixing portion 102 can be an opening where a powder can enter from the venturi tube 105. In some embodiments, the powder inlet 106 can be an opening where the venturi tube 105 protrudes into the mixing portion 102.

In some embodiments, mixing portion 102 can also comprise a gas inlet 107. The gas inlet 107 of the mixing portion 102 can provide gas flow through the mixing cavity 108. For example, gas entering the mixing portion 102 through the gas inlet 107 can travel through the mixing cavity 108 and then exit the mixing portion 102. In some embodiments, the gas inlet 107 can be configured to deliver a compressed gas such as oxygen, nitrogen, or the like. In some embodiments, the flow of gas through the mixing portion 102 is configured to create suction through the venturi tube 105. In particular, the gas flow from the gas inlet 107 provides a venturi effect as it passes the venturi tube 105 located in mixing portion 102 thereby drawing the premixed powder 109 into the mixing cavity 108. In some embodiments, the gas inlet 107 can be positioned to be perpendicular to the direction of flow of the powder through the mixing portion 102. In some embodiments, the gas inlet 107 can be in-line with the gas flow through the mixing portion 102 (e.g. FIG. 3).

In some embodiments, gas inlet 107 is positioned at an angle to the direction of powder flow where the angle is from about 0 degrees to about 90 degrees. In some embodiments, the angle is less than about 90 degrees, less than about 80 degrees, less than about 70 degrees, less than about 60 degrees, less than about 50, or even less then about 40 degrees. In some embodiments, the angle is at least about 90 degrees, at least about 95 degrees, at least about 100 degrees, at least about 105 degrees, at least about 110 degrees, or at least about 115 degrees. In some embodiments, the angle is between about 90 degrees and about 180 degrees.

In some embodiments, mixing portion 102 can also comprise a mixing cavity 108. The mixing cavity 108 can be configured to provide an environment where the gas flow 111 and the premixed powder 109 interact. In particular, the force of the gas flow 111 traveling through the mixing cavity 107 can deagglomerate the premixed powder 109 into a post-mixed or blended powder 110. Deagglomerating the premixed powder 109 can comprise breaking down an agglomerate into smaller sized particles. In particular, the premixed powder 109 can be more easily mixed or blended once airborne due to interparticle forces being eliminated. Dispersion or deagglomeration of the premixed powder 109 can be accomplished using a venturi nozzle, a fluid bed, a spinning disk, or the like. In some embodiments, the volume and speed of the gas flow 111 traveling through the mixing portion 102 can be configured to create a high shear point as the premixed powder 109 is dispensed into the mixing cavity 108. In some embodiments, the disclosed system can mix or blend aerosolized powder.

In some embodiments, the surface of the powder input portion and mixing portion will be generally smooth on the inner surface. It should be understood that virtually all surfaces may be characterized as having a certain amount of surface roughness. By smooth it is meant that any projections or depressions on the surface can be generally small in comparison to the average agglomerate size of the powder being moved or dispensed. As will be readily understood, this will minimize any tendency for the powder agglomerates to get pressed into and retained on the surface of the powder mixing apparatus. In some embodiments, the surface roughness average (Ra) will be less than about 50 microinches (1.27 micron), in some embodiments less than about 20 microinches (0.51 micron), and in some embodiments less than about 10 microinches (0.25 micron). In addition to the smooth surface finish, it may be desirable for the surface of the powder mixing apparatus to be generally inert with respect to the powder being dispensed. Although relative inertness of the powder mixing apparatus may vary according to the particular powder being dispensed it will be readily apparent to one of skill in the art how to select an inert material for a given powder. Metals, such as steel, stainless steel, and aluminum, ceramics, and/or rigid plastics, such as polycarbonate, polyether ether ketone (PEEK), acrylonitrile butadiene styrene will typically be relatively inert towards a wide range of powders.

The size of the venturi tube and powder inlet opening diameters will generally depend on the type and amount of powder to be dispensed, as well as on the desired area for the powder to be dispensed into. In some embodiments, the openings will have a width or gap of at least about 0.2 mm, in some embodiments, the cap is at least about 0.3 mm or at least about 0.5 mm. In some embodiments, the openings will have a width or gap of less than about 2 mm, less than about 1.5 mm, or less than about 1 mm. In some embodiments, the openings will have a length of at least about 0.5 cm, at least about 1 cm, or at least about 2 cm. In some embodiments, the openings will have a length of less than about 100 cm, less than about 50 cm, or less than about 20 cm.

The powder input portion and mixing portion can be any mechanism and powder source suitable for advancing or moving the premixed powder. The mixing apparatuses and methods of the present disclosure may utilize a control system. The control system can be any suitable system that directs the motion of the gas and premixed powder through the system. In some embodiments, the control system is an electrical or computer controller that sends signals to the gas inlet (e.g., volume of compressed gas) so as to effect the desired rate of motion of the premixed powder through the system. The control systems may be adjustable with respect to parameters that influence the powder mixing process. That is, the control system may allow for user inputs to independently adjust any one or all of the volume of gas, the type of gas, and the time that the gas flow is operational. In some embodiments certain of these parameters may be fixed, but it should be noted that they are still independently selected for a system of more than one gas inlet. For example, a portion of the powder mixing apparatus may work in concert with the control system to generate intermittent and/or alternating gas flow. In some embodiments, the control system can be non-adjustable by an operator and contains fixed values suitable for a specific powder mixing operation.

In some embodiments, the powder mixing apparatus 100 can comprise a collection portion 103. Once the premixed powder 109 is dispersed in the air in the mixing cavity 108, the post-mixed powder 110 can be collected. The manner in which the aerosolized powder can impact the homogeneity or uniformity of the collected post-mixed powder 110. In some embodiments, the collection of post-mixed powder 110 in the collection portion 103 does not lead to segregation of the mixed powder. In some embodiments, if an aerodynamic classifier such as a cyclone or the like is used to collect the post-mixed powder 110, no aerodynamic segregation of the post-mixed powder 110 occurs. In some embodiments, it is can be useful to collect the post-mixed powder 110 by use of a bag filter (e.g. FIG. 2). A bag filter is generally used to collect fine powder from a jet mill. In some embodiments, collection portion 103 does not rely significantly on aerodynamic properties in order to collect the airborne particles, and thus is unlikely to cause aerodynamic separation of the post-mixed powder 110.

In some embodiments, the collection portion 103 can be configured to be at the end of a powder mixing apparatus system. It should be understand that the disclosed embodiments can also be configured into a system to allow multiple powder mixing operations before collection of the post-mixed powder 110. In certain some embodiments, the powder mixing apparatus system can comprise multiple powders mixing operations of a single apparatus in-line with one another. Meaning, a post-mixed powder 110 can be dispensed back into the powder input device of the same apparatus. In particular, the disclosed embodiment can create a looped system to allow multiple powder mixing operations to create a more uniform or homogenous post-mix powder 110.

In some embodiments, the powder mixing apparatus system can comprise multiple powder mixing operations with multiple apparatuses in-line with one another. For example, a post-mixed powder 110 can be dispensed into the powder input device of a second powder mixing apparatus and the process can be repeated one or more times before collection of the down stream post-mixed powder. Such a repetition of apparatuses and mixing operations produces a more uniform or homogenous post-mix powder 110.

FIG. 2 is a schematic top perspective view of a powder mixing apparatus 100 according to one or more embodiments. As discuss above, the powder mixing apparatus 100 has a powder input portion 201, a mixing portion 202, and a collection portion 203. Mixing portion 202 comprises a gas inlet 207 and encompasses all aspects of the disclosed embodiments.

Figure 3:
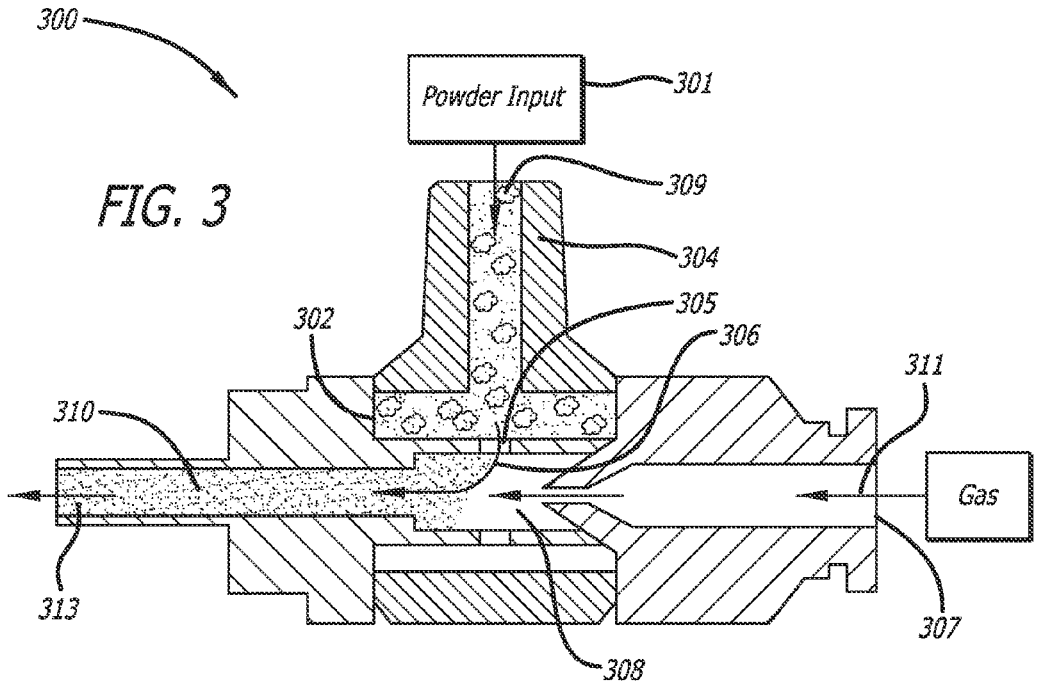
FIG. 3 is a schematic cross-sectional side view of the powder mixing apparatus as viewed along line B in FIG. 4.
Figure 4:
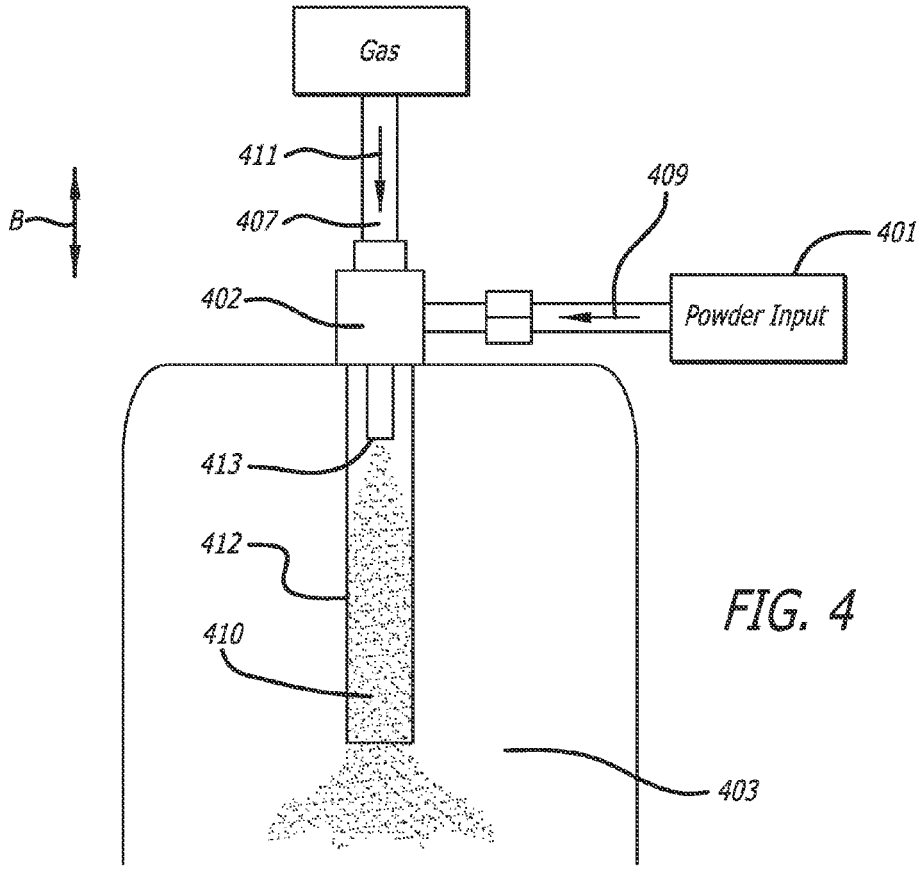
FIG. 4 is a schematic side plan view of a powder mixing apparatus.

Further embodiments of a powder mixing apparatus 300 are shown in FIGS. 3-4. As discuss above in FIG. 1-2, the powder mixing apparatus 300 comprises a powder input portion 301 and a mixing portion 302. In some embodiments, a powder input portion 301 is perpendicular to the gas flow 311 of the mixing portion 302. As discussed in FIG. 1-2, powder input portion 301 comprises a dispensing device 304 wherein the dispensing device 304 comprises a venturi tube 305. In the embodiment, the dispensing device 304 can be a tube, canal, or the like to dispense premixed powder 309 into the venturi tube 305.

In some embodiments, the venturi tube 304 does not extend into the powder inlet 306 of the mixing portion 302. In some embodiments, mixing portion 302 can also comprise a gas inlet 307 in-line with the gas flow 311 of the mixing portion. The gas inlet 307 of the mixing portion 302 can provide gas flow through the mixing cavity 308. For example, gas entering the mixing portion 302 through the gas inlet 307 can travel through the mixing cavity 308, pass the powder inlet 306, and then exit 313 the mixing portion 302. As disclosed above, the mixing cavity 308 can be configured to provide an environment where the gas flow 311 and the premixed powder 309 interact. In particular, the force of the gas flow 311 traveling through the mixing cavity 307 can deagglomerate the premixed powder 309 into a post-mixed powder 310.

FIG. 4 is a schematic side plan view of a powder mixing apparatus. In some embodiments, a mixing cavity extension 412 can be configured to be integrated with the exit 413 of the mixing portion 402. In particular, the powder input portion 401 dispenses premixed powder 409 to the mixing device 402. The gas inlet 407 can provide gas flow 411 to the mixing portion 402. The gas 411 and premixed powder then interact in the mixing cavity of the mixing portion to create a post-mixed powder 410. In some embodiments, the mixing cavity extension 412 can be used to extend the time a particular premixed powder 409 is mixed, blended, or deagglomerated before the post-mixed powder 403 is dispensed into the collection portion 403.

Figure 5:
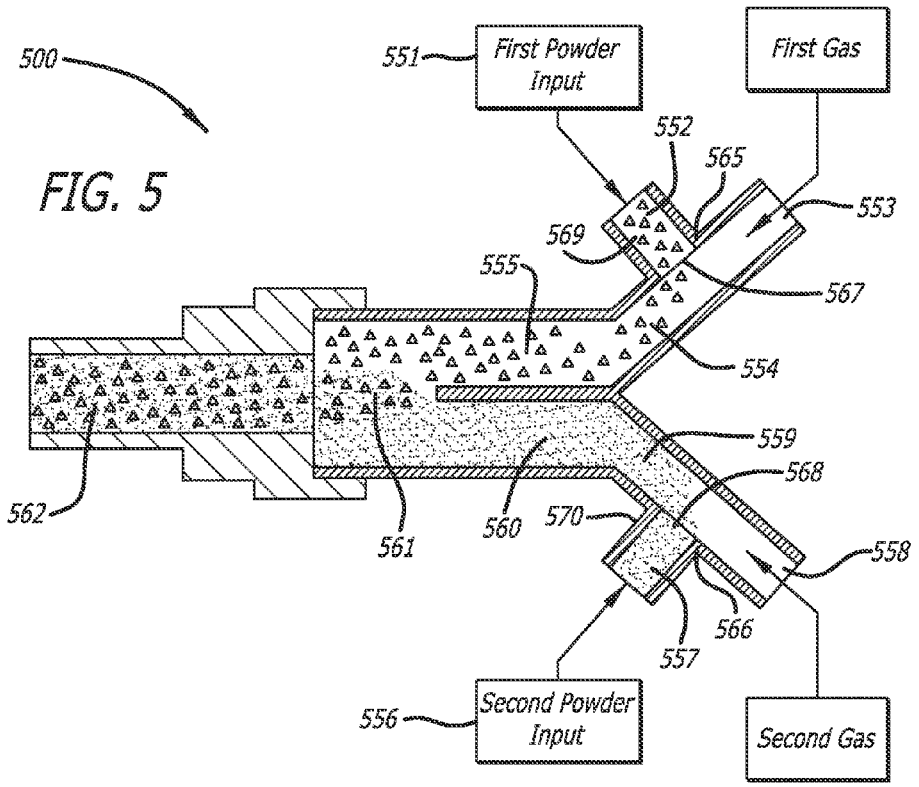
FIG. 5 is a schematic cross-sectional side view of the powder mixing apparatus as viewed along line C in FIG. 6.
Figure 6:
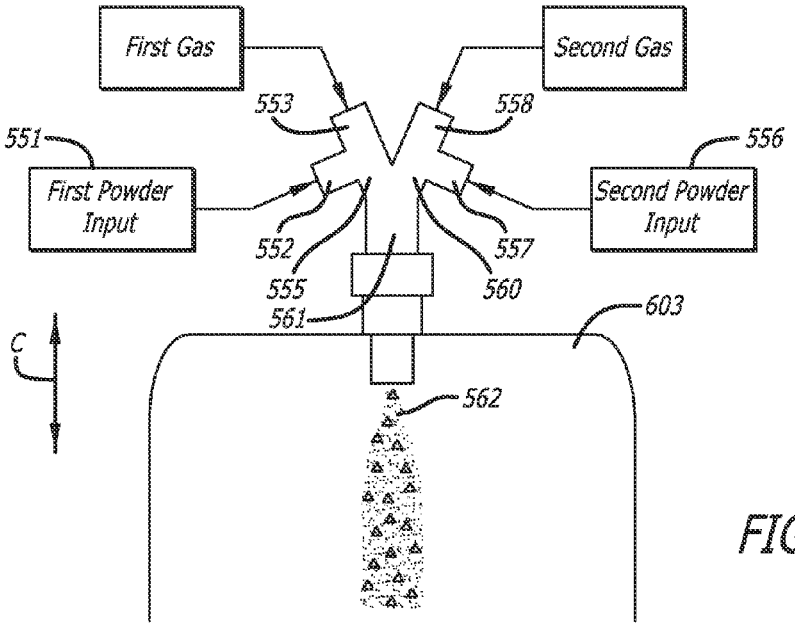
FIG. 6 is a schematic side plan view of a powder mixing apparatus.

Another embodiment of a powder mixing apparatus 500 is shown in FIGS. 5-6. In some embodiments, the powder mixing apparatus 500 comprises a first powder input portion 551 comprising a first dispensing device 569, a first mixing portion 565 comprising a first powder inlet 567 a first gas inlet 553, and a first mixing cavity 554, wherein the first dispensing device comprises a first venturi tube configured to dispense a first premixed powder 552 into the first mixing portion 565, wherein the first gas inlet 553 is configured to provide a first flow of gas into the first mixing cavity 554, and wherein the gas and the first premixed powder 552 interact in the first mixing cavity 554 to form the first post-mixed powder 555.

Additionally, the disclosed embodiment further comprises a second powder input portion 556 comprising a second dispensing device 570, a second mixing portion 566 comprising a second powder inlet 568, a second gas inlet 558, and a second mixing cavity 559, wherein the second gas inlet 558 is configured to provide a second flow of gas into the second mixing cavity 559, wherein the second flow of gas and a second premixed powder 557 received from the second powder input portion 556 interact in the second mixing cavity 559 to form a second post-mixed powder 560, and wherein the first mixing portion 565 and the second mixing portion 566 are positioned so that the first post-mixed powder 555 and second post-mixed powder 560 are dispensed together into a third powder input portion 561 to form a third premixed powder 562. In some embodiments, the third powder input portion 561 can be configured to blend, mix, or deagglomerate with or without the flow of gas. Meaning, the third post-mixed powder 562 can be additionally mixed, blended, or deagglomerated before the third premixed powder 562 is dispensed into the collection portion 603 (FIG. 6).

In some embodiments, the powder mixing apparatus 500 further comprises a third mixing portion comprising a third powder inlet, a third gas inlet, and a third mixing cavity, wherein the third gas inlet is configured to provide a third flow of gas into the third mixing cavity, and wherein the third flow of gas and the third premixed powder received from the third powder input portion interact in the third mixing cavity to form a third post-mixed powder.

In some embodiments, a method of feeding powder using powder feeding apparatus is as generally described above. The method comprises a first step of providing a premixed powder to a powder input portion, the powder input portion comprising a dispensing device. Then mixing the premixed powder in a mixing portion, the mixing portion comprising a powder inlet, a gas inlet, and a mixing cavity, wherein the dispensing device comprises a venturi tube configured to dispense the premixed powder into the mixing portion, wherein the gas inlet is configured to provide a flow of gas into the mixing cavity, and the powder inlet is configured to dispense the premixed powder into the mixing cavity, and wherein the flow of gas and the premixed powder interact in the mixing cavity to form a post-mixed powder.

The provided premixed powder will generally be a non-free flowing powder. By non-free flowing it is meant that the premixed powder can be filled into a powder mixing apparatus as described above and the premixed powder will arch or bridge across the opening of the venturi tube. That is, in the absence of some force or other urging of the powder, the premixed powder will not flow through the opening of the venturi tube into the mixing portion. In contrast, a free flowing premixed powder will pour through the opening merely due to the force of gravity on the powder.

In some embodiments, the provided premixed powder can be cohesive. That is, individual particles of the powder have the tendency to adhere to each other in a manner that tends to inhibit the flowability of the powder. It is generally the case that powders made up of fine particles, that is, a micronized powder, will often be cohesive. Other influences that may cause a powder to be cohesive include particle shape, with irregular, non-spherical shapes often leading to increased cohesion, as well as free moisture content, which can cause capillary forces between individual particles. There are a variety of quantitative measures of powder cohesion as discussed below.

In some embodiments the provided premixed powder can have an angle of repose greater than about 40 degrees, in some embodiments greater than about 50 degrees, and in some embodiments greater than about 60 degrees. Angle of repose may be determined according to ASTM D6393-08, "Standard Test Method for Bulk Solids Characterization by Carr Indices".

In some embodiments the provided premixed powder can have a Jenike flow index of less than about 4, in some embodiments less than about 3, and in some embodiments less than about 2. The Jenike flow index may be determined according to ASTM D6128-06, "Standard Test Method for Shear Testing of Bulk Solids Using the Jenike Shear Cell".

In some embodiments the provided premixed powder can have a Carr Compressibility Index of greater than about 15, in some embodiments greater than about 20, and in some embodiments greater than about 25. The Carr Compressibility Index may be determined according to ASTM D6393-08, "Standard Test Method for Bulk Solids Characterization by Carr Indices".

In some embodiments the free water content of the premixed powder can be greater than 2% by weight, in some embodiments greater than 5%, and in some embodiments greater than 10%. Free water is generally considered to be water that is adsorbed to a powder and that can be removed under drying conditions that will remove water, but that will not otherwise change the powder (e.g, cause chemical degradation, melting or other change of crystal morphology). This is in contrast, for instance, to the bound water present in molecular hydrates, such as α-lactose monohydrate, or water entrapped within crystalline powders. Free water content can generally be determined by loss of weight upon drying at appropriate conditions for a particular powder.

In some embodiments the provided premixed powder has an average, unagglomerated, or primary particle size of less than about 50 microns, less than about 20 microns, or less than about 10 microns.

In some embodiments, the provided premixed powder will at least partially comprise relatively large agglomerates with an average dimension greater than or equal to about 2 mm. In many instances, agglomerates may be irregular in size and thus be characterized by differing dimensions depending on measurement orientation. The size of an irregular agglomerate may be equated to a spherical particle having the same volume as the agglomerate and the average dimension of such an irregular agglomerate reported as the diameter of the equivalent spherical particle. Without wishing to be bound to any particular theory, it is believed that the process of dispensing the provided powder through the slot shaped gap imparts a shear force to the powder that tends to break up agglomerates in the provided powder, such that the dispensed powder is more finely dispersed. In some embodiments, the dispensed powder will at least partially comprise fine agglomerates with an average dimension less than 2000 microns, in some embodiments less than 200 microns, and in some embodiments less than 50 microns. In some embodiments, the dispensed powder will be essentially free of large agglomerates having an average dimension greater than or equal to about 0.5 mm. In some embodiments, the provided powder may be pre-sieved. That is, the powder will have been subjected to a sieving process that may serve to break down large agglomerates. In such cases, the provided powder may already comprise fine agglomerates, but the shear forces imparted to the powder may still break down the agglomerates into smaller agglomerates in the dispensed powder.

The provided premixed powder may comprise a wide variety of different materials, including without limitation, foodstuffs, medicaments, cosmetics, abrasive granules, and absorbents.

In some embodiments the provided premixed powder can be a medicament or drug. In some embodiments the provided premixed powder can be two or more medicaments or drugs mixed into a predetermined ratio. For example, a premixed powder can be two or more medicaments, cosmetics, abrasive granules, absorbents, or the like. In some embodiments the provided premixed powder's predetermined ratio can have a relative standard deviation (% RSD) of medicaments or drugs that is undesirably high, e.g., the % RSD is higher between premixed samples than it is in the post-mixed powder. % RSD is a standardized measure of dispersion of a probability distribution or frequency distribution. Meaning the provided premixed powder can have a higher variability between micronized powder dosages than a post-mixed powder. In some embodiments, the post-mixed powder achieved provides a more homogeneous mixture which is more accurate and consistent for each dosage then the premixed powder.

According to some mixtures of powders, a desirable % RSD between different samples is less than 50%, less than 40%, less than 30%, less than 20%, less than 10%, less than 5%, and even less than 3%. Using the methods and apparatuses disclosed herein, the Δ % RSD (which is defined herein as the difference between the % RSD of a premixed powder and the % RSD of the post-mixed powder) of a mixed powder is greater than 10% (for example, where the % RSD of the premixed powder is 30% and the % RSD of the post-mixed powder is 20%→30%−20%=10%), greater than 20%, greater than 30%, greater than 40%, greater than 50%, greater than 60%, and even greater than 70%.

Accurate and precise dispensing of powder may be desired in preparing all types of pharmaceutical dosage forms, including oral dosages, such as tablets and capsules, transdermal dosages, such as transdermal patches, topical dosages, such as creams and gels, and inhalation dosages, such as dry powder inhalers, metered dose inhalers, and nebulizers. The dispensed powders may be especially desirable for use in dry powder inhalers, as the drug in a dry powder inhaler remains in particulate form until inhaled by a patient and it is generally desirable that the inhaled particulates be very fine in size.

Accurate dispensing or dosing can be particularly advantageous when amount of drug administered is small such that minor variations in the drug content can have a large impact. According to some embodiments, the amount of drug to be dispensed or dosed is less than about 10 milligrams, less than 1 milligram or 1000 micrograms, less than about 500 micrograms, less than about 300 micrograms, less than bout 200 micrograms, or less than about 100 micrograms. In some embodiments, the post-mixed powder comprises at least two pharmaceutical compositions or compounds, and each compound, respectively, may be present in an amount that is less than about 200 micrograms, less than about 100 micrograms, or less than about 50 micrograms.

Suitable medicaments include any drug or combination of drugs that is a solid or that may be incorporated in a solid carrier. Suitable drugs include those for the treatment of respiratory disorders, e.g., bronchodilators, anti-inflammatories (e.g., corticosteroids) anti-allergics, anti-asthmatics, anti-histamines, and anti-cholinergic agents. Other drugs such as anorectics, anti-depressants, anti-hypertensive agents, anti-neoplastic agents, anti-tussives, anti-anginals, anti-infectives (e.g., antibacterials, antibiotics, anti-virals), anti-migraine drugs, anti-peptics, dopaminergic agents, analgesics, beta-adrenergic blocking agents, cardiovascular drugs, hypoglaecemics, immunomodulators, lung surfactants, prostaglandins, sympathomimetics, tranquilizers, steroids, vitamins and sex hormones, vaccines and other therapeutic proteins and peptides may also be employed.

A group of preferred drugs for use in inhalation dosages include albuterol, atropine, beclomethasone dipropionate, budesonide, butixocort propionate, ciclesonide, clemastine, cromolyn, adrenaline and epinephrine, ephedrine, fentanyl, flunisolide, fluticasone, formoterol, ipratropium bromide, isoproterenol, lidocaine, mometasone, morphine, nedocromil, pentamidine isoethionate, pirbuterol, prednisolone, resiquimod, salmeterol, terbutaline, tetracycline, tiotropium, triamcinolone, vilanterol, zanamivir, 4-amino-, 2-trimethyl-1H-imidazo[4,5-c]quinoline-1-ethanol, 2,5-diethyl-10-oxo-1,2,4-triazolo[1,5-c]pyrimido[5,4-b][1,4]thiazine, 1-(1-ethylpropyl)-1-hydroxy-3-phenylurea, and pharmaceutically acceptable salts and solvates thereof, and mixtures thereof.

According to some embodiments, each dose of a post-mixed powder desirably comprises between about 200 micrograms and about 150 micrograms of fluticasone propionate and between about 30 micrograms and about 60 micrograms of salmeterol xinafoate. Standard methods of mixing these two components generally produce undesirably high dose to dose variation. In contrast, using the methods and apparatuses disclosed herein, a suitably homogenous mixture can be achieved comprising about 186 micrograms of fluticasone propionate and about 44.7 micrograms of salmeterol xinafoate.

EXAMPLES

Example 1

Albuterol Base and Budesonide Generated Using Powder Mixing Apparatus

A powder mixing apparatus of the design described in FIGS. 1-2 was used. A premixed powder was obtained by combining albuterol base and budesonide in a 4:1 ratio in a 4×4 Ziploc plastic bag. The powder in the bag was mixed by shaking and kneading the powder to establish a crude premixed powder. The resultant powder was analyzed for blend uniformity of the premixed powder by taking ten powder samples, each approximately 500 μg, and placing them into HPLC auto-sampler vials and extracting them with 1 ml of methanol. Samples were shaken to ensure they were completely dissolved into the solvent and then were analyzed by HPLC-UV. The average ratio of albuterol base to budesonide was 3.96:1. The % RSD in the ratio of the two APIs in this premixed powder was 6.3%.

Approximately 3 grams of the premixed powder was processed though the powder mixing apparatus shown in FIGS. 1-2. The bulk flow rate was set to approximately 40 Lpm. It took approximately 2 minutes to disperse the entire 3 grams of formulation. The powder was recovered from the bag filter and the blend uniformity was analyzed by taking 15 samples of approximately 500 μg each. The average ratio of albuterol base to budesonide was 4.06:1. The % RSD in the ratio of the two APIs in this blend was 2.3%.

Example 2

Fluticasone Propionate and Salmeterol Xinafoate Generated Using Powder Mixing Apparatus A powder mixing apparatus of the design described in FIGS. 1-2 was used. A premixed powder was obtained by combining fluticasone propionate and salmeterol xinafoate in a 6.3:1 ratio (of fluticasone propionate to salmeterol base) using a Turbula. The resultant powder was analyzed for blend uniformity of the premixed powder by taking forty powder samples, each approximately 30 μg, and placing them into HPLC auto-sampler vials and extracting them with 1 ml of diluent (15:85 0.6% NH40HAc (aq):MeOH). Samples were shaken to ensure they were completely dissolved into the solvent and then were analyzed by HPLC-UV. The average ratio of fluticasone propionate to salmeterol base was 6.3:1. The % RSD in the ratio of the two APIs in this premixed powder was 11.5%.

Approximately 10 grams of the premixed powder was processed though the air mixer shown in FIGS. 1-2. The bulk flow rate was set to approximately 42.8 Lpm. It took approximately 10 minutes to disperse the entire 10 grams of formulation. The powder was recovered from the bag filter and the resultant powder was analyzed for blend uniformity by taking twenty powder samples, each approximately 90 μg, and placing them into HPLC auto-sampler vials and extracting them with 1 ml of diluent (15:85 0.6% NH40HAc (aq):MeOH). Samples were shaken to ensure they were completely dissolved into the solvent and then were analyzed by HPLC-UV. The average ratio of albuterol base to budesonide was 6.5:1. The % RSD in the ratio of the two APIs in this blend was 2.1%.

Examples 3-26

Fluticasone Propionate and Salmeterol Xinafoate Generated Using Powder Mixing Apparatus Preparation of Premixed Powders:

Premixed powder of fluticasone propionate and salmeterol xinafoate (nominally 6.3:1 of fluticasone propionate to salmeterol base; note—approximately 1.453 grams of salmeterol xinafoate contains approximately 1.000 grams of salmeterol base) were made using four different configurations and then mixed using the powder mixing apparatus described in FIGS. 3-4. The resultant powder from each premixed powder was analyzed for blend uniformity by taking forty powder samples, each approximately 30 μg, and placing them into HPLC autosampler vials and extracting them with 1 ml of diluent (15:85 0.6% NH40HAc (aq):MeOH). Samples were shaken to ensure they were completely dissolved into the solvent and then were analyzed by HPLC-UV. The ratio of fluticasone propionate to salmeterol base was calculated for each sample and the % RSD of this ratio was determined from these measurements.

Premixed Powder A:

15.5555 gm of salmeterol xinafoate and 15.5575 gm of fluticasone propionate were weighed out and added to a jar. This was placed in a Turbula mixer for 30 min at 22% powder of 72 rpm. Then 51.8991 gm of fluticasone propionate was added to jar. The powder deposited on the wall of the jar was scraped down with a spatula. The jar was placed in a Turbula mixer for 30 min at 22% powder of 72 rpm. The powder deposited on the wall of the jar was scraped down with a spatula. Place jar in turbula for 30 min at 67% powder of 72 rpm. The powder deposited on the wall of the jar was scraped down with a spatula. The jar was placed in the Turbula for 1 hour at 22% powder of 23 rpm. The powder deposited on the wall of the jar was scraped down with a spatula. The % RSD in the ratio was approximately 11.5%.

Premixed Powder C:

1.8774 gm of salmeterol xinafoate and 8.1856 gm of fluticasone propionate were weighed out and added to a jar. This was placed in a Turbula mixer for 30 min at 22% powder of 72 rpm. The powder deposited on the wall of the jar was scraped down with a spatula. The % RSD in the ratio was approximately 47.8%.

Premixed Powder D:

1.8775 gm of salmeterol xinafoate and 8.1293 gm of fluticasone propionate were weighed out and added to a jar. This was placed in a Turbula mixer for 15 min at 22% powder of 72 rpm. The powder deposited on the wall of the jar was scraped down with a spatula. The % RSD in the ratio was approximately 82.3%.

Premixed Powder E:

1.8746 gm of salmeterol xinafoate and 8.1340 gm of fluticasone propionate were weighed out and added to a jar. This was shaken by hand for 3 minutes along its vertical axis. The powder deposited on the wall of the jar was scraped down with a spatula. The jar was then placed in a Turbula mixer for 30 min at 22% powder of 72 rpm. The powder deposited on the wall of the jar was scraped down with a spatula. The jar was again placed in a Turbula mixer for 30 min at 22% powder of 72 rpm. The powder deposited on the wall of the jar was scraped down with a spatula. The % RSD in the ratio was approximately 29.1%.

For Examples 3 through 14, the powder was processed using the powder mixing apparatus of the design described in FIGS. 3-4 and then sampled for blend content uniformity. The powder from one of the premixed powders was dispersed through the powder mixing apparatus consisting of a PISCO VCH-10 with a powder input tube diameter of 5 mm. The pressure of the compressed nitrogen gas flowing through the inlet nozzle was set 50 psi. The powder was collected in a Sturtevant exhaust bag filter with a stainless steel lid. After all of the powder was dispersed through the system, the powder was recovered from the bag filter and the stainless steel lid and collected in a vial. The resultant powder from each premixed powder was analyzed for blend uniformity of by taking 40 powder samples, each approximately 30 μg, and placing them into HPLC autosampler vials and extracting them with 1 ml of diluent (15:85 0.6% NH40HAc (aq):MeOH). Samples were shaken to ensure they were completely dissolved into the solvent and then were analyzed by HPLC-UV. The ratio of fluticasone propionate to salmeterol base was calculated for each sample and the % RSD of this ratio was determined from these measurements.

Example 3

Approximately 3.0066 grams of powder from Premixed powder A was dispersed through the powder mixing apparatus consisting of a PISCO VCH-10 with a powder input tube diameter of 5 mm using a compressed nitrogen pressure of 50 psi. The % RSD in the blend ratio was approximately 4.3%.

Example 4

Approximately 3.0892 grams of powder from Premixed powder A was dispersed through the powder mixing apparatus consisting of a PISCO VCH-10 with a powder input tube diameter of 5 mm using a compressed nitrogen pressure of 50 psi. The % RSD in the ratio was approximately 7.0%.

Example 5

Approximately 3.0724 grams of powder from Premixed powder A was dispersed through the powder mixing apparatus consisting of a PISCO VCH-10 with a powder input tube diameter of 5 mm using a compressed nitrogen pressure of 50 psi. The % RSD in the ratio was approximately 2.7%.

Example 6

Approximately 3.0513 grams of powder from Premixed powder C was dispersed through the powder mixing apparatus consisting of a PISCO VCH-10 with a powder input tube diameter of 5 mm using a compressed nitrogen pressure of 50 psi. The % RSD in the ratio was approximately 4.8%.

Example 7

Approximately 3.1030 grams of powder from Premixed powder C was dispersed through the powder mixing apparatus consisting of a PISCO VCH-10 with a powder input tube diameter of 5 mm using a compressed nitrogen pressure of 50 psi. The % RSD in the ratio was approximately 6.4%.

Example 8

Approximately 3.1365 grams of powder from Premixed powder C was dispersed through the powder mixing apparatus consisting of a PISCO VCH-10 with a powder input tube diameter of 5 mm using a compressed nitrogen pressure of 50 psi. The % RSD in the ratio was approximately 3.5%.

Example 9

Approximately 3.1017 grams of powder from Premixed powder D was dispersed through the powder mixing apparatus consisting of a PISCO VCH-10 with a powder input tube diameter of 5 mm using a compressed nitrogen pressure of 50 psi. The % RSD in the ratio was approximately 9.4%.

Example 10

Approximately 3.1175 grams of powder from Premixed powder D was dispersed through the powder mixing apparatus consisting of a PISCO VCH-10 with a powder input tube diameter of 5 mm using a compressed nitrogen pressure of 50 psi. The % RSD in the ratio was approximately 7.5%.

Example 11

Approximately 3.1576 grams of powder from Premixed powder D was dispersed through the powder mixing apparatus consisting of a PISCO VCH-10 with a powder input tube diameter of 5 mm using a compressed nitrogen pressure of 50 psi. The % RSD in the ratio was approximately 6.1%.

Example 12

Approximately 3.0655 grams of powder from Premixed powder E was dispersed through the powder mixing apparatus consisting of a PISCO VCH-10 with a powder input tube diameter of 5 mm using a compressed nitrogen pressure of 50 psi. The % RSD in the ratio was approximately 4.5%.

Example 13

Approximately 3.1839 grams of powder from Premixed powder E was dispersed through the powder mixing apparatus consisting of a PISCO VCH-1 0 with a powder input tube diameter of 5 mm using a compressed nitrogen pressure of 50 psi. The % RSD in the ratio was approximately 3.5%.

Example 14

Approximately 3.1795 grams of powder from Premixed powder E was dispersed through the powder mixing apparatus consisting of a PISCO VCH-1 0 with a powder input tube diameter of 5 mm using a compressed nitrogen pressure of 50 psi. The % RSD in the ratio was approximately 5.0%.

For Examples 15 through 23, the powder was processed using the powder mixing apparatus of the design described in FIGS. 3-4 and then sampled for blend content uniformity. The powder from one of the premixed powders was dispersed through the powder mixing apparatus consisting of a PISCO VCH-10 with a powder input tube diameter of 5 mm. The pressure of the compressed nitrogen gas flowing through the inlet nozzle was set 50 psi. The powder was collected in a Sturtevant exhaust bag filter with a stainless steel lid. After all of the powder was dispersed through the system, the powder was recovered from the bag filter and the stainless steel lid and collected in a vial. The resultant powder from each premixed powder was analyzed for blend uniformity of by taking 20 powder samples (unless otherwise noted), each approximately 30 μg, and placing them into HPLC autosampler vials and extracting them with 1 ml of diluent (15:85 0.6% NH40HAc (aq):MeOH). Samples were shaken to ensure they were completely dissolved into the solvent and then were analyzed by HPLC-UV. The ratio of fluticasone propionate to salmeterol base was calculated for each sample and the % RSD of this ratio was determined from these measurements.

Example 15

The remaining powder from Example 3 was dispersed through the powder mixing apparatus consisting of a PISCO VCH-1 0 with a powder input tube diameter of 5 mm using a compressed nitrogen pressure of 50 psi. The % RSD in the ratio was approximately 3.6%.

Example 16

The remaining powder from Example 4 was dispersed through the powder mixing apparatus consisting of a PISCO VCH-10 with a powder input tube diameter of 5 mm using a compressed nitrogen pressure of 50 psi. The % RSD in the ratio was approximately 3.4%.

Example 17

The remaining powder from Example 5 was dispersed through the powder mixing apparatus consisting of a PISCO VCH-1 0 with a powder input tube diameter of 5 mm using a compressed nitrogen pressure of 50 psi. The % RSD in the ratio was approximately 3.1%.

Example 18

The remaining powder from Example 6 was dispersed through the powder mixing apparatus consisting of a PISCO VCH-1 0 with a powder input tube diameter of 5 mm using a compressed nitrogen pressure of 50 psi. The % RSD in the ratio was approximately 3.2%.

Example 19

The remaining powder from Example 7 was dispersed through the powder mixing apparatus consisting of a PISCO VCH-1 0 with a powder input tube diameter of 5 mm using a compressed nitrogen pressure of 50 psi. The % RSD in the ratio was approximately 4.4%.

Example 20

The remaining powder from Example 8 was dispersed through the powder mixing apparatus consisting of a PISCO VCH-1 0 with a powder input tube diameter of 5 mm using a compressed nitrogen pressure of 50 psi. Only 10 samples were analyzed for the blend uniformity analysis. The % RSD in the ratio was approximately 3.3%.

Example 21

The remaining powder from Example 9 was dispersed through the powder mixing apparatus consisting of a PISCO VCH-10 with a powder input tube diameter of 5 mm using a compressed nitrogen pressure of 50 psi. The % RSD in the ratio was approximately 3.9%.

Example 22

The remaining powder from Example 10 was dispersed through the powder mixing apparatus consisting of a PISCO VCH-10 with a powder input tube diameter of 5 mm using a compressed nitrogen pressure of 50 psi. The % RSD in the ratio was approximately 3.7%.

Example 23

The remaining powder from Example 11 was dispersed through the powder mixing apparatus consisting of a PISCO VCH-10 with a powder input tube diameter of 5 mm using a compressed nitrogen pressure of 50 psi. The % RSD in the ratio was approximately 3.5%.

Example 24

The remaining powder from Example 12 was dispersed through the powder mixing apparatus consisting of a PISCO VCH-10 with a powder input tube diameter of 5 mm using a compressed nitrogen pressure of 50 psi. Only 10 samples were analyzed for the blend uniformity analysis. The % RSD in the ratio was approximately 4.1%.

Example 25

The remaining powder from Example 13 was dispersed through the powder mixing apparatus consisting of a PISCO VCH-10 with a powder input tube diameter of 5 mm using a compressed nitrogen pressure of 50 psi. Only 10 samples were analyzed for the blend uniformity analysis. The % RSD in the ratio was approximately 1.8%.

Example 26

The remaining powder from Example 14 was dispersed through the powder mixing apparatus consisting of a PISCO VCH-10 with a powder input tube diameter of 5 mm using a compressed nitrogen pressure of 50 psi. The % RSD in the ratio was approximately 4.3%.

Figure 7:
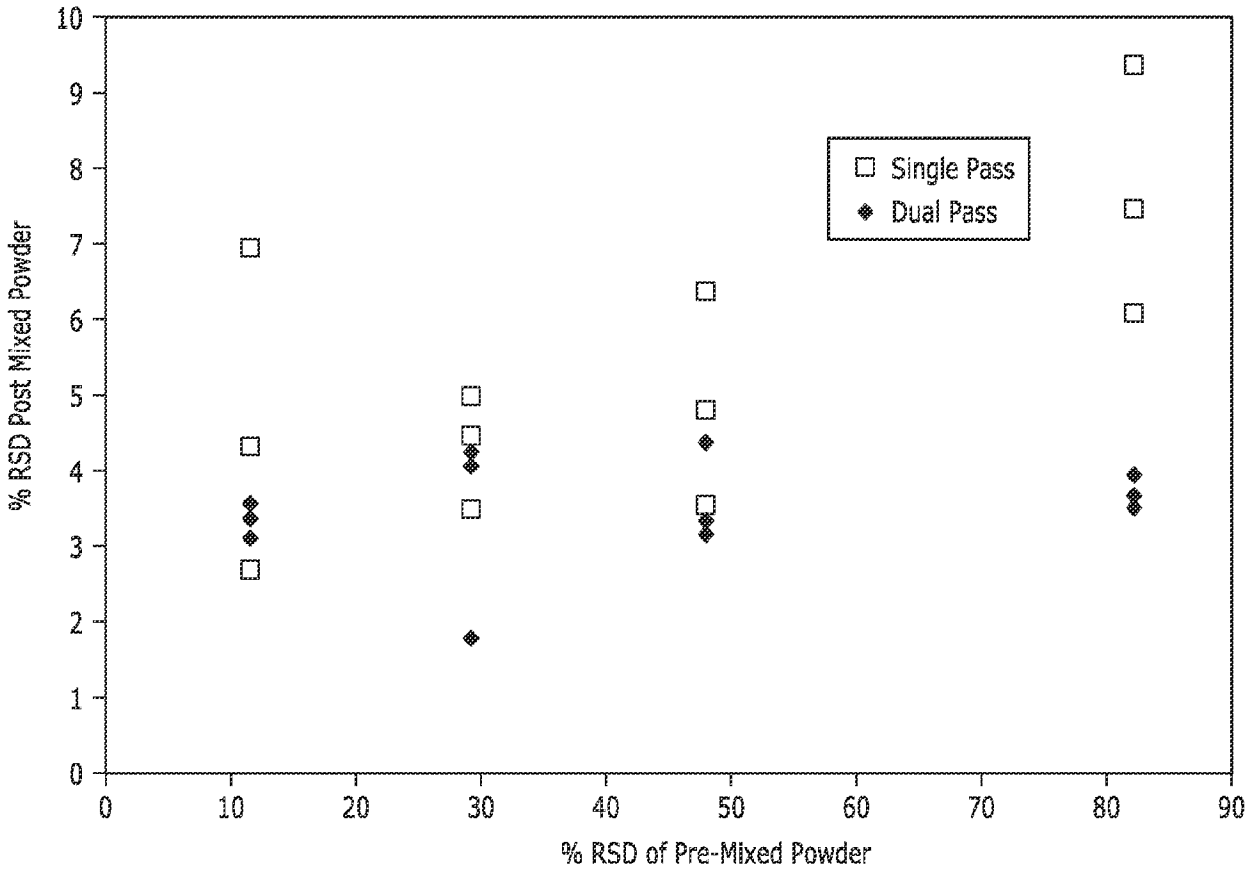
FIG. 7 is a graphical representation of the influence of premixed powder uniformity with post-mixed powder uniformity for Examples 3-26.

The results for Examples 3 through 26 are shown graphically in FIG. 7 and in Table 1. When a single pass through the powder mixing apparatus was used, the premixed powders with the best blend uniformity provided better blend uniformity of the final powder. However, when a second pass of the powder through the powder mixing apparatus described in FIGS. 3-4 was used the final blend uniformity did not appear to be influenced by the premixed powder uniformity.

TABLE 1

| Example Number | Premixed powder | Premixed powder % RSD | Number of Passes | % RSD |
|---|---|---|---|---|
| Ex 3 | A | 11.5 | 1 | 4.34 |
| Ex 4 | A | 11.5 | 1 | 6.96 |
| Ex 5 | A | 11.5 | 1 | 2.70 |
| Ex 6 | C | 47.9 | 1 | 4.81 |
| Ex 7 | C | 47.9 | 1 | 6.39 |
| Ex 8 | C | 47.9 | 1 | 3.55 |
| Ex 9 | D | 82.3 | 1 | 9.38 |
| Ex 10 | D | 82.3 | 1 | 7.47 |
| Ex 11 | D | 82.3 | 1 | 6.09 |
| Ex 12 | E | 29.1 | 1 | 4.46 |
| Ex 13 | E | 29.1 | 1 | 3.50 |
| Ex 14 | E | 29.1 | 1 | 4.99 |
| Ex 15 | A | 11.5 | 2 | 3.57 |
| Ex 16 | A | 11.5 | 2 | 3.38 |
| Ex 17 | A | 11.5 | 2 | 3.14 |
| Ex 18 | C | 47.9 | 2 | 3.17 |
| Ex 19 | C | 47.9 | 2 | 4.40 |
| Ex 20 | C | 47.9 | 2 | 3.33 |
| Ex 21 | D | 82.3 | 2 | 3.95 |
| Ex 22 | D | 82.3 | 2 | 3.69 |
| Ex 23 | D | 82.3 | 2 | 3.52 |
| Ex 24 | E | 29.1 | 2 | 4.08 |
| Ex 25 | E | 29.1 | 2 | 1.80 |
| Ex 26 | E | 29.1 | 2 | 4.26 |

Examples 27-29

Albuterol Sulfate and Lactose Monohydrate Generated Using Powder Mixing Apparatus For Examples 27 through 29, the powder was processed using the powder mixing apparatus of the design described in FIGS. 3-4 and then sampled for blend content uniformity. The following examples demonstrate the utility of blending micronized lactose monohydrate and albuterol sulfate using the powder mixing methods of the present disclosure. This may be desirable when it is desired to deliver low doses of a drug, such as albuterol sulfate. The MCT selected for these examples (Tool 5a) contains about 100 to 110 μg of powder after coating using the Taper GMP Coater and process described in WO 07/112267 A2. It is difficult to consistently coat powder loads much lower than this. So, to deliver 10 μg of albuterol sulfate from the Taper DPI, one approach would be to coat Tool 5a MCT with a 9:1 blend of albuterol sulfate:lactose monohydrate. Due to the size of the dimples on the Taper MCT, it is desirable for this blend to use lactose monohydrate of a micronized size. In Examples 27 through 29, Tool 5a MCT was coated with different albuterol sulfate: lactose monohydrate blends generated the powder mixing method. The uniformity of the albuterol sulfate content was measured for 18 different sections of MCT. Each sampled section contained 2.0 cm2 of the MCT which corresponds to single dose. The albuterol sulfate content for each dosing section was determined by dissolving the drug with an appropriate solvent and then analyzing with HPLC-UV. The % RSD of the albuterol content provides an indication of the blend uniformity. Ideally, the % RSD would be less than or equal to about 3% in order to provide confidence in the ability to meet regulatory dosing uniformity requirements.

Example 27

Albuterol sulfate and micronized lactose monohydrate were blended using the procedure described and using the powder mixing apparatus. The resultant blend was used to fill the dimples of a Taper MCT using the process described in WO 07/112267 A2. The average amount of albuterol sulfate per dosing section was 10.8 μg. The % RSD in the amount of albuterol sulfate per dosing section was 3.6%. When MCT coated with this blend was loaded into Taper devices and tested using the Next Generation Impactor (NGI) with a pressure drop set at 4 kPa and a total volume of 4 liters, the fine particle fraction (<5 μm) was 71%. This is exceptionally high and was substantially higher than is typically obtained using the albuterol sulfate alone.

Example 28

Albuterol sulfate and micronized lactose monohydrate were blended using the procedure described and using the powder mixing apparatus. The resultant blend was used to fill the dimples of a Taper MCT using the process described in WO 07/112267 A2. The average amount of albuterol sulfate per dosing section was 18.5 μg. The % RSD in the amount of albuterol sulfate per dosing section was 3.1%. When MCT coated with this blend was loaded into Taper devices and tested using the Next Generation Impactor (NGI) with a pressure drop set at 4 kPa and a total volume of 4 liters, the fine particle fraction (<5 μm) was 68%. This is exceptionally high and was substantially higher than is typically obtained using the albuterol sulfate alone.

Example 29

Albuterol sulfate and micronized lactose monohydrate were blended using the procedure described and using the powder mixing apparatus. The resultant blend was used to fill the dimples of a Taper MCT using the process described in WO 07/112267 A2. The average amount of albuterol sulfate per dosing section was 29.1 μg. The % RSD in the amount of albuterol sulfate per dosing section was 2.6%. When MCT coated with this blend was loaded into Taper devices and tested using the Next Generation Impactor (NGI) with a pressure drop set at 4 kPa and a total volume of 4 liters, the fine particle fraction (<5 μm) was 65%. This is exceptionally high and was substantially higher than is typically obtained using the albuterol sulfate alone.

EMBODIMENTS

The following embodiments are specifically contemplated by the authors:

Embodiment 1

A powder mixing apparatus comprising:

a first powder input portion comprising a first dispensing device;

a first mixing portion comprising a first powder inlet, a first gas inlet, and a first mixing cavity;

wherein the first dispensing device comprises a first opening configured to dispense a first premixed powder into the first mixing portion;

wherein the first gas inlet is configured to provide a first flow of gas into the first mixing cavity; and wherein the gas and the first premixed powder interact in the first mixing cavity to form a first post-mixed powder.

Embodiment 2

The powder mixing apparatus of embodiment 1, further comprising:

a second powder input portion comprising a second dispensing device;

a second mixing portion comprising a second powder inlet, a second gas inlet, and a second mixing cavity;

wherein the second input portion receives the first post-mixed powder from the first powder mixing portion;

wherein the second dispensing device comprises a second opening configured to dispense the first post-mixed powder into the second mixing portion, wherein the second gas inlet is configured to provide a second flow of gas into the second mixing cavity and the second powder inlet is configured to dispense the first post-mixed powder into the second mixing cavity, and wherein the second flow of gas and the first post-mixed powder interact in the second mixing cavity to form a second post-mixed powder, Embodiment 3

The powder mixing apparatus of embodiment 2, wherein the second mixing portion is positioned to deliver the second post-mixed powder to the first powder input portion.

Embodiment 4

The powder mixing apparatus of embodiment 1, further comprising:

a second powder input portion comprising a second dispensing device;

a second mixing portion comprising a second powder inlet, a second gas inlet, and a second mixing cavity;

wherein the second gas inlet is configured to provide a second flow of gas into the second mixing cavity;

wherein the second flow of gas and a second premixed powder received from the second powder input portion interact in the second mixing cavity to form a second post-mixed powder; and wherein the first mixing portion and the second mixing portion are positioned so that the first post-mixed powder and second post-mixed powder are dispensed together into a third powder input portion to form a third premixed powder.

Embodiment 5

The powder mixing apparatus of embodiment 4, further comprising:

a third mixing portion comprising a third powder inlet, a third gas inlet, and a third mixing cavity;

wherein the third gas inlet is configured to provide a third flow of gas into the third mixing cavity; and wherein the third flow of gas and the third premixed powder received from the third powder input portion interact in the third mixing cavity to form a third post-mixed powder.

Embodiment 6

A method of mixing a powder, the method comprising:

providing a first premixed powder to a first powder input portion, the first powder input portion comprising a first dispensing device;

mixing the first premixed powder in a first mixing portion, the first mixing portion comprising a first powder inlet, a first gas inlet, and a first mixing cavity;

wherein the first dispensing device comprises a first opening configured to dispense the first premixed powder into the first mixing portion;

wherein the first gas inlet is configured to provide a first flow of gas into the first mixing cavity, and the first powder inlet is configured to dispense the first premixed powder into the first mixing cavity; and wherein the first flow of gas and the first premixed powder interact in the first mixing cavity to form a first post-mixed powder.

Embodiment 7

The method of embodiment 6, further comprising:

providing the first post-mixed powder to a second powder input portion, the second powder input portion comprising a second dispensing device;

mixing the first post-mixed powder in a second mixing portion, the second mixing portion comprising a second powder inlet, a second gas inlet, and a second mixing cavity;

wherein the second dispensing device comprises a second opening configured to dispense the first post-mixed powder into the second mixing portion;

wherein the second gas inlet is configured to provide a second flow of gas into the second mixing cavity, and the second powder inlet is configured to dispense the first post-mixed powder into the second mixing cavity; and wherein the second flow of gas and the first post-mixed powder interact in the second mixing cavity to form a second post-mixed powder.

Embodiment 8

The method of embodiment 7, further comprising transporting the second post-mixed powder to the first powder input portion.

Embodiment 9

The method of embodiment 6, further comprising:

providing a second premixed powder to a second powder input portion, the second powder input portion comprising a second dispensing device;

mixing the second premixed powder in a second mixing portion, the second mixing portion comprising a second powder inlet, a second gas inlet, and a second mixing cavity;

wherein the second dispensing device comprises a second opening configured to dispense the second premixed powder into the second mixing portion;

wherein the second gas inlet is configured to provide a second flow of gas into the second mixing cavity, and the second powder inlet is configured to dispense the second premixed powder into the second mixing cavity;

wherein the second flow of gas and the second premixed powder interact in the second mixing cavity to form a second post-mixed powder; and wherein the first mixing portion and the second mixing portion are positioned so that the first post-mixed powder and second post-mixed powder are dispensed together into a third powder input portion to form a third premixed powder.

Embodiment 10

The method of embodiment 9, further comprising:

mixing the third premixed powder in a third mixing portion comprising a third powder inlet, a third gas inlet, and a third mixing cavity;

wherein the third gas inlet is configured to provide a third flow of gas into the third mixing cavity; and wherein the third flow of gas and the third premixed powder received from the third powder input portion interact in the third mixing cavity to form a third post-mixed powder.

Embodiment 11

The powder mixing apparatus of embodiment 1 2, 3, 4, or 5 or the method of embodiment 6, 7, 8, 9, or 10, wherein the first, second, and/or third premixed powder comprises at least two powders.

Embodiment 12

The powder mixing apparatus of embodiment 1 2, 3, 4, 5, or 11 or the method of embodiment 6, 7, 8, 9, 10, or 11, wherein the first opening comprises a tube that extends into the mixing portion.

Embodiment 13

The powder mixing apparatus of embodiment 1 2, 3, 4, 5, 11, or 12 or the method of embodiment 6, 7, 8, 9, 10, 11, or 12, wherein the first, second, and/or third gas inlet delivers a compressed gas.

Embodiment 14

The powder mixing apparatus of embodiment 1 2, 3, 4, 5, 11, 12, or 13 or the method of embodiment 6, 7, 8, 9, 10, 11, 12, or 13, wherein the first flow of gas through the first mixing portion is configured to create suction through the first opening drawing the first premixed powder into the first mixing cavity.

Embodiment 15

The powder mixing apparatus of embodiment 1 2, 3, 4, 5, 11, 12, 13, or 14 or the method of embodiment 6, 7, 8, 9, 10, 11, 12, 13, or 14, wherein the first flow of gas passing the first powder inlet effects a high shear on the first premixed powder as it enters the first mixing portion.

Embodiment 16

The powder mixing apparatus of embodiment 1 2, 3, 4, 5, 11, 12, 13, 14, or 15 or the method of embodiment 6, 7, 8, 9, 10, 11, 12, 13, 14, or 15, wherein the first mixing portion further comprises a first control system.

Embodiment 17

The powder mixing apparatus or method of embodiment 16, wherein the first control system is configured to regulate the volume of powder and gas dispersed into the first mixing portion.

Embodiment 18

The powder mixing apparatus of embodiment 1 2, 3, 4, 5, 11, 12, 13, 14, 15, 16, or 17 or the method of embodiment 6, 7, 8, 9, 10, 11, 12, 13, 14, 15, 16, or 17, wherein the premixed powder is cohesive.

Embodiment 19

The powder mixing apparatus or method of embodiment 18, wherein the cohesive premixed powder has a repose angle greater than about 40 degrees.

Embodiment 20

The powder mixing apparatus or method of embodiment 18 or 19, wherein the cohesive premixed powder has a Jenike flow index of less than about 4.

Embodiment 21

The powder mixing apparatus or method of embodiment 18, 19, or 20, wherein the cohesive premixed powder has a Carr index of greater than about 20.

Embodiment 22

The powder mixing apparatus or method of embodiment 18, 19, 20, or 21, wherein the cohesive premixed powder has an average, primary particle size of less than about 20 microns.

Embodiment 23

The powder mixing apparatus or method of embodiment 18, 19, 20, 21, or 22, wherein the cohesive premixed powder comprises a drug.

Embodiment 24

The powder mixing apparatus or method of embodiment 18, 19, 20, 21, 22, or 23, wherein the cohesive premixed powder comprises more than 2% by weight of free water.

Embodiment 25

The powder mixing apparatus or method of embodiment 18, 19, 20, 21, 22, 23, or 24, wherein the cohesive premixed powder comprises fine agglomerates with an average dimension of 20 to 2000 microns.

Embodiment 26

The powder mixing apparatus of embodiment 1 2, 3, 4, 5, 11, 12, 13, 14, 15, 16, or 17 or the method of embodiment 6, 7, 8, 9, 10, 11, 12, 13, 14, 15, 16, or 17, wherein the at least one of the first and second openings comprises a tube.

Embodiment 27

The powder mixing apparatus or method of embodiment 26, wherein the tube extends at least partially into the mixing cavity.

Embodiment 28

The powder mixing apparatus or method of embodiment 26 or 27, wherein the tube is a venturi tube.

The present disclosure should not be considered limited to the particular examples and embodiments described herein, but rather should be understood to cover all aspects of the disclosed subject matter as fairly set out in the attached claims. Various modifications, equivalent processes, as well as numerous structures to which the present disclosure can be applicable will be readily apparent to those of skill in the art to which the present disclosure is directed upon review of this disclosure.

The invention claimed is:

1. A powder mixing apparatus comprising:

a first powder input portion comprising a first dispensing device;

a venturi tube;

a first mixing portion comprising a first powder inlet, a first gas inlet, and a first mixing cavity;

wherein the first dispensing device comprises a first opening configured to dispense a first premixed powder through the venturi tube and into the first mixing portion;

wherein the first premixed powder comprises at least two micronized powders;

wherein the first gas inlet is configured to provide a first flow of a pressurized gas into the first mixing cavity; and wherein the gas and the first premixed powder interact in the first mixing cavity to form a first post-mixed powder.

2. The powder mixing apparatus of claim 1, further comprising:

a second powder input portion comprising a second dispensing device;

a second mixing portion comprising a second powder inlet, a second gas inlet, and a second mixing cavity;

wherein the second input portion receives the first post-mixed powder from the first powder mixing portion;

wherein the second dispensing device comprises a second opening configured to dispense the first post-mixed powder into the second mixing portion, wherein the second gas inlet is configured to provide a second flow of gas into the second mixing cavity and the second powder inlet is configured to dispense the first post-mixed powder into the second mixing cavity, and wherein the second flow of gas and the first post-mixed powder interact in the second mixing cavity to form a second post-mixed powder.

3. The powder mixing apparatus of claim 2, wherein the second mixing portion is positioned to deliver the second post-mixed powder to the first powder input portion.

4. The powder mixing apparatus of claim 1, further comprising:

a second powder input portion comprising a second dispensing device;

a second mixing portion comprising a second powder inlet, a second gas inlet, and a second mixing cavity;

wherein the second gas inlet is configured to provide a second flow of gas into the second mixing cavity;

wherein the second flow of gas and a second premixed powder received from the second powder input portion interact in the second mixing cavity to form a second post-mixed powder; and wherein the first mixing portion and the second mixing portion are positioned so that the first post-mixed powder and second post-mixed powder are dispensed together into a third powder input portion to form a third premixed powder.

5. The powder mixing apparatus of claim 4, further comprising:

a third mixing portion comprising a third powder inlet, a third gas inlet, and a third mixing cavity;

wherein the third gas inlet is configured to provide a third flow of gas into the third mixing cavity; and wherein the third flow of gas and the third premixed powder received from the third powder input portion interact in the third mixing cavity to form a third post-mixed powder.

6. The powder mixing apparatus of claim 1, wherein the first premixed powder comprises at least two powders.

7. The powder mixing apparatus of claim 1, wherein the first gas inlet delivers a compressed gas.

8. The powder mixing apparatus of claim 1, wherein the first flow of gas through the first mixing portion is configured to create suction through the first opening drawing the first premixed powder into the first mixing cavity.

9. The powder mixing apparatus of claim 1, wherein the first flow of gas passing the first powder inlet effects a high shear on the first premixed powder as it enters the first mixing portion.

10. The powder mixing apparatus of claim 1, wherein the first mixing portion further comprises a first control system.

11. The powder mixing apparatus of claim 10, wherein the first control system is configured to regulate the volume of powder and gas dispersed into the first mixing portion.

12. The powder mixing apparatus of claim 1, wherein the premixed powder is cohesive.

13. The powder mixing apparatus of claim 12, wherein the cohesive premixed powder has a repose angle greater than about 40 degrees.

14. The powder mixing apparatus of claim 12, wherein the cohesive premixed powder has a Jenike flow index of less than about 4.

15. The powder mixing apparatus of claim 12, wherein the cohesive premixed powder has a Carr index of greater than about 20.

16. The powder mixing apparatus of claim 12, wherein the cohesive premixed powder has an average, primary particle size of less than about 20 microns.

17. The powder mixing apparatus of claim 12, wherein the cohesive premixed powder comprises a drug.

18. The powder mixing apparatus of claim 12, wherein the cohesive premixed powder comprises more than 2% by weight of free water.

19. The powder mixing apparatus of claim 12, wherein the cohesive premixed powder comprises fine agglomerates with an average dimension of 20 to 2000 microns.

* * * * *